US005868494A

United States Patent [19]

Campbell et al.

[11] Patent Number: 5,868,494

[45] Date of Patent: Feb. 9, 1999

[54] WHEELED MOTORIZED MIXER

[75] Inventors: Jeffery D. Campbell, Fresno; Rick Dean Fox, Santa Cruz, both of Calif.

[73] Assignee: Power Technology Unlimited, In., Fresno, Calif.

[21] Appl. No.: 119,545

[22] Filed: Jul. 20, 1998

[51] Int. Cl.[6] ..... B28C 5/20; B28C 7/16

[52] U.S. Cl. ..... 366/47; 366/54; 366/61; 366/232

[58] Field of Search ..... 366/45–48, 53–63, 366/92, 93, 185, 213, 214, 208, 209, 220, 225, 228, 232, 606

[56] References Cited

U.S. PATENT DOCUMENTS

| | | | |
|---|---|---|---|
| 2,507,077 | 5/1950 | Williams . | |
| 2,808,241 | 10/1957 | Beran, Jr. | 366/57 |
| 2,837,321 | 6/1958 | Gleason | 366/48 |
| 2,859,950 | 11/1958 | Graybill | 366/48 |
| 2,961,225 | 11/1960 | Graybill | 366/60 |
| 2,981,524 | 4/1961 | Yager | 366/48 |
| 3,062,515 | 11/1962 | Green | 366/47 |
| 3,084,917 | 4/1963 | Graybill | 366/48 |
| 3,326,537 | 6/1967 | Wallace | 366/47 |
| 3,879,010 | 4/1975 | Ray | 366/47 |
| 4,197,015 | 4/1980 | Moser et al. | 366/47 |
| 4,223,997 | 9/1980 | Violet et al. | 366/47 |
| 4,634,284 | 1/1987 | Bishop | 36/57 |
| 5,137,366 | 8/1992 | Hill et al. | 366/47 |

*Primary Examiner*—Charles E. Cooley
*Attorney, Agent, or Firm*—Jeffrey A. Hall

[57] ABSTRACT

A mixing apparatus, comprising, a frame, a pair of handles secured to the frame with each handle having a proximal and a distal end thereto and a pair of downwardly depending support elements. A first wheel is secured to the distal ends of the pair of handles by frame elements and a rear set of wheels are secured to the proximal ends of the pair of handles by frame elements. A mounting element is secured to the frame for supporting a drive engine. A drive chain mechanism is linked to a toothed wheel and to the drive engine, the toothed wheel having an internal brake drum and internal brake shoes. The internal brake drum and internal brake shoes are connected to a brake cable having a tension reduction cam for tension reduction. A centrifugal clutch for engagement with the drive mechanism is linked to a throttle operably engaged to the to the drive engine. A mixing barrel is secured to the frame, the mixing barrel being linked to a hydraulic motor shaft connected to a hydraulic pump and a hydraulic pump motor which is engaged to a gear reduction box. The mixing barrel is equipped with a handle for control and dumping of the mixing barrel.

12 Claims, 2 Drawing Sheets

WHEELED MOTORIZED MIXER

BACKGROUND OF THE INVENTION

1. Field of Invention

This invention relates mixing apparatuses, and more particularly to mixing apparatuses which are equipped with wheels, an engine, and drive means for propelling the apparatus.

2. Description of the Related Art

The usefulness of mixing apparatuses are well known to those involved in construction, gardening, and other uses for mixing cement, gravel, dirt, and other particulates in a mix with water or other particulates. Prior mixers have been proposed and developed which are placed on various apparatuses such as truck beds, motorized frames, wheels and the like.

Such mixers are useful for particular applications, however, all suffer from significant disadvantages and limitations when used for small mixing jobs, construction, home repair, garden work and the like. For example, such mixers are bulky, cumbersome, and difficult and dangerous to use in many types situations such as home use, construction, landscaping and the like.

Accordingly, it is the primary object of this invention to provide a motorized mixer with a hydraulic driven pump which is lightweight, strong, balanced, and efficient at mixing a wide variety of different substances such as cement, gravel, dirt, and other particulates. The motorized mixer of the present invention has high performance capability and possesses sufficient power to drive the mixer at both slow speeds or at high speeds with small, medium or large loads. The mixer of the present invention is equipped with a front wheel and a rear set of wheels for balance and ease of movement.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a wheeled mixing apparatus is provided, having a frame with a pair of handles secured to the frame. Each handle has a proximal and a distal end thereto and a pair of downwardly depending support elements. A first wheel is secured to the distal ends of the pair of handles by frame elements and a rear set of wheels are secured to the proximal ends of the pair of handles by frame elements. A mounting element is secured to the frame for supporting a drive engine. A drive chain mechanism is linked to a wheel and to the drive engine, the wheel having an internal brake drum and internal brake shoes. The internal brake drum and internal brake shoes are connected to a brake cable having a tension reduction cam for tension reduction. A centrifugal clutch for engagement with the drive mechanism is linked to throttle operably engaged to the drive engine. A mixing barrel is secured to the frame, the mixing barrel being linked to a hydraulic motor shaft connected to a hydraulic pump and a to a hydraulic pump motor which is engaged to a gear reduction box. The mixing barrel is preferably equipped with a handle for control and dumping of the mixing barrel.

The wheeled motorized mixer of the present invention is lightweight, balanced, efficient, and highly effective at allowing a user to mix loads of all sizes with great efficiency and control. The mixer of the present invention allows a user to mix loads easily and efficiently thereby providing both a highly efficient and safe mixing apparatus.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, a wheeled mixing apparatus having a frame with a pair of handles secured to the frame. Each handle has a proximal and a distal end thereto and a pair of downwardly depending support elements. A first wheel is secured to the distal ends of the pair of handles by frame elements and a rear set of wheels are secured to the proximal ends of the pair of handles by frame elements. A mounting element is secured to the frame for supporting a drive engine. A drive chain mechanism is linked to a wheel and to the drive engine, the wheel having an internal brake drum and internal brake shoes. The internal brake drum and internal brake shoes are connected to a brake cable having a tension reduction cam for tension reduction. A centrifugal clutch for engagement with the drive mechanism is linked to throttle operably engaged to the to the drive engine. A mixing barrel is secured to the frame, the mixing barrel being linked to a hydraulic motor shaft connected to a hydraulic pump and a hydraulic pump motor which is engaged to a gear reduction box. The mixing barrel is preferably equipped with a handle for control and dumping of the mixing barrel.

In accordance with the present invention, there is also provided an improved mixing apparatus of the type in which a frame is secured to a pair of handles each handle having a proximal and a distal end thereto and a pair of downwardly depending support elements, a first wheel is secured to the distal ends of the pair of handles by frame elements, a drive engine is mounted on the frame, and a mixing barrel is secured to the frame, wherein the improvement comprises a rear set of wheels secured to the proximal ends of the pair of handles by a frame element; a mounting element secured to the frame for supporting the drive engine; a drive mechanism including a chain and a sprocket operably linked to a wheel and to the drive engine with the wheel having an internal brake drum and internal brake shoes. The internal brake drum and internal brake shoes are linked to a brake cable having a cam for tension reduction. A centrifugal clutch for engagement with the drive mechanism is provided and a throttle mechanism is operably engaged to the centrifugal clutch and to the drive engine. A mixing barrel is mounted to the frame with the mixing barrel being linked to a hydraulic motor shaft connected to a hydraulic pump and a hydraulic pump motor engaged to a gear reduction box. The mixing barrel is preferably secured to a handle for control and emptying of the contents of the mixing barrel.

Figure 1:
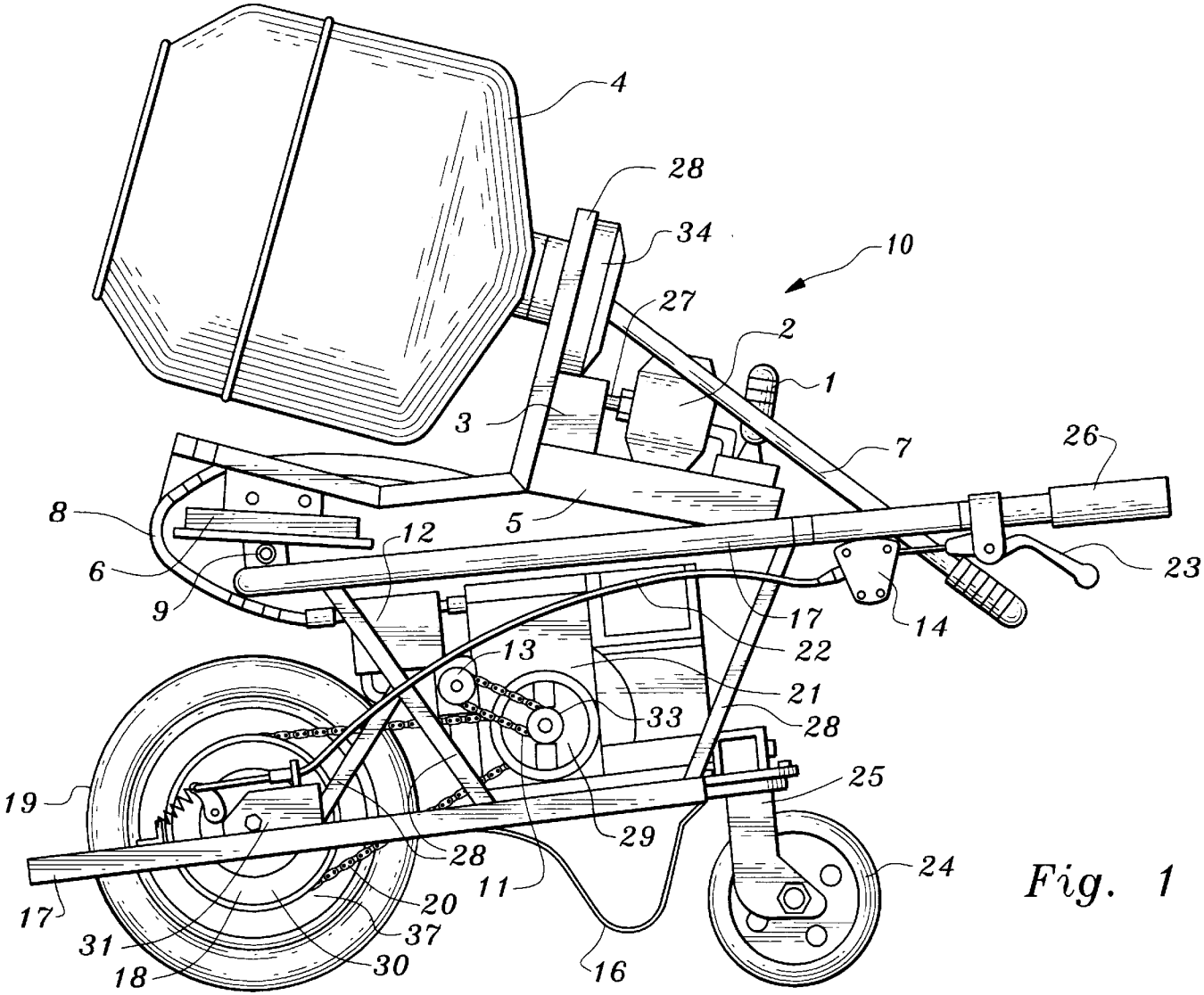
FIG. 1 is a left side elevational view of a wheeled motorized mixer, according to the invention.

In FIG. 1, the wheeled motorized mixer 10, is shown according to a preferred embodiment of the invention with frame elements 17, mounting frame 5, and upright frame elements 28. Upright frame elements 28 downwardly depend and may be used for additional support and stability. The frame is secured to a pair of handles 26 each having a proximal and a distal end thereto and which are preferably provided with handle grips. A pair of metal skids 16 may be provided and are preferably secured to frame 17 by welding, or bolts, screws or other mechanical fastening means.

Figure 2:
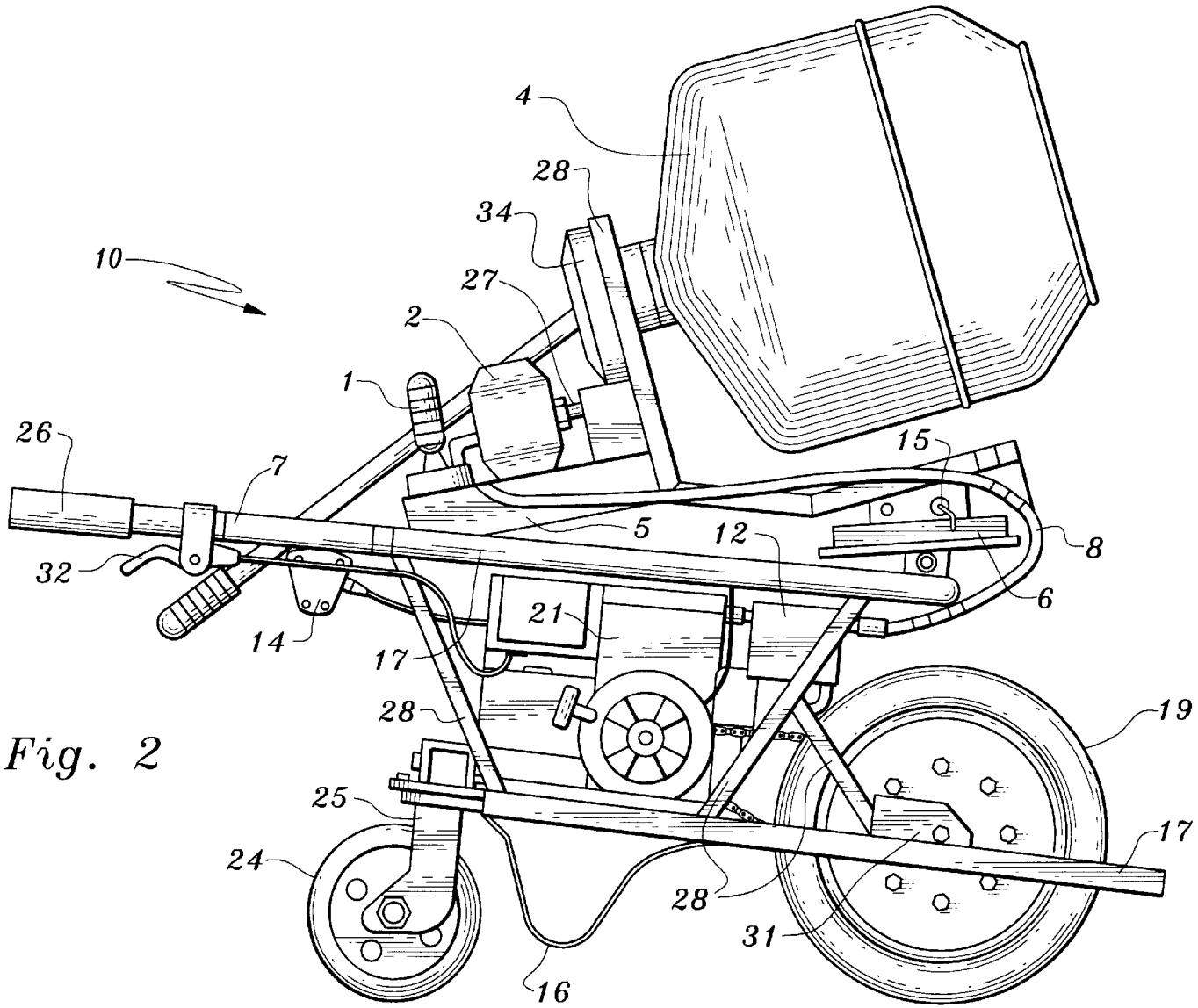
FIG. 2 is a right side elevational view of such mixer, according to the invention.

As seen in FIGS. 1 and 2, a mixer barrel 4, which is preferably composed of steel or other durable and resilient material is secured to upright element 28 and mounting frame 5. A base mount 6 is shown secured by steel mounting rod 9 with steel collars, but may be welded or secured by other fastening means such as welding, bolts, screws, or the like. Mixer barrel 4 may be barrel shaped as shown, or in alternative embodiments be tub shaped or bucket shaped or otherwise configured as desired. Mixer barrel 4 may be sized as desired, however, a convenient size for many applications has been found to be a four cubic foot size barrel.

In FIGS. 1, 2, a first wheel 19 is secured to the distal ends of handles 26 by frame 17 and upright elements 28. Wheel 19 preferably has a 16 inch by 4 inch three ply tire, however, other sizes may be substituted as desired. Wheel 19 may be provided with extension bearing hubs if desired. Wheel 19 is operably linked by an axle to sprocket wheel 18. Sprocket wheel 18 is preferably a toothed sprocket, but may be otherwise, having an internal brake drum 37 and internal brake shoes 30 operably linked to a brake cable 22 with cam 14 for controlled tension reduction, and to brake lever 23. Axle housing 31 is secured to the axle by an axle bolt, preferably a hex head axle bolt with nylon locknut.

Best seen in FIG. 1, a drive mechanism, preferably comprising drive chain 20 is operably linked to sprocket wheel 18 and to engine 21, which is preferably a 3.5 horsepower gas motor with recoil start means, and is preferably mounted on frame 17 with bolts, screws or other mechanical fastening means. A centrifugal clutch 29 is operably linked to drive chain 20 and to drive sprocket 33 operably linked to chain 11. Drive chain 20 and chain 11 may be protected with chain guards if desired. In the preferred embodiment, engine 21 drives drive chain 20 and wheel sprocket 18 is propelled by centrifugal clutch 29 which is attached to the drive shaft of engine 21.

In FIGS. 1 and 2, a rear set of wheels 24 are preferably 6 inch caster wheels with ball brings and a swivel flange and are preferably provided with tires. However, in alternative embodiments different sizes and type wheels and tires may be provided as desired. Wheels 24 are detachable from the frame and are preferably mounted to removable tubing frame 25.

Brake lever 23 on the left handle and a throttle lever and toggle switch 32 on the right handle are shown. Of course, which handle the brake lever or the throttle switch is placed on is not critical. When throttle lever 32 is pressed this engages centrifugal clutch 29 which engages the chain driven wheel sprocket 18 secured to wheel 19. Mixer 10 is operated by engaging forward and reverse lever 1 which is operably linked to centrifugal clutch 29, which at idle speeds engages drive sprocket 33. This engages hydraulic pump 13 by a chain 11 which engages hydraulic pump motor 2 with hydraulic pump motor shaft 27. When hydraulic pump 13 is engaged it drives hydraulic fluid though the reservoir tank 12 through hydraulic hose 8 which drives hydraulic motor head 34. Hydraulic motor head 34 engages gear reduction box 3 which is operably connected to mixer barrel 4 allowing for a mix such as concrete, sand, gravel, dirt, or other particulate to be mixed with a fluid or other particulate. To unload or dump the mixer barrel 4, locking pin 15 is disconnected and mixer handle 7 is lifted. By lifting handle 7, the frame 5 pivots about rod 9 to discharge material from the mixing barrel 4. Once emptied, mixer barrel 4 is then positioned back on mounting frame 5 and locking pin 15 is reset.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A mixing apparatus, comprising:

a frame;

a pair of handles secured to said frame, each handle having a proximal and a distal end thereto and a pair of downwardly depending support elements;

a first wheel secured to the distal ends of the pair of handles by frame elements;

a rear set of wheels secured to the proximal ends of the pair of handles by frame elements;

a mounting element secured to said frame for supporting a drive engine;

a drive mechanism including a chain and a sprocket operably linked to said drive engine, said first wheel being linked by a drive chain to said drive engine by a toothed wheel mounted on said first wheel, a centrifugal clutch coupled to said drive engine and said sprocket, said first wheel having an internal brake drum and internal brake shoes; said internal brake drum and internal brake shoes being linked to a brake cable having a cam for tension reduction;

a throttle mechanism being operably engaged to said centrifugal clutch and to said drive engine; and a mixing barrel secured to said frame, said mixing barrel being operably linked to a hydraulic pump and a hydraulic pump motor, said hydraulic pump being linked to said hydraulic pump motor by a hose, said hydraulic pump driven by said chain, said mixing barrel being operably secured to a handle for control and dumping of said mixing barrel.

2. The mixing apparatus of claim 1, wherein said drive engine is a gasoline powered engine.

3. The mixing apparatus of claim 1, wherein said internal brake drum of said first wheel is operably linked to a brake lever mounted on one of said pair of handles by said brake cable.

4. The mixing apparatus of claim 1, further including a pair of metal skids secured to said frame.

5. The mixing apparatus of claim 1, wherein said rear set of wheels are detachably mounted to said frame.

6. The mixing apparatus of claim 1, wherein said mixing barrel is composed of a metal.

7. A mixing apparatus of the type in which a frame is secured to a pair of handles, each handle having a proximal and a distal end thereto and a pair of downwardly depending support elements, a first wheel is secured to the distal ends of the pair of handles by frame elements, a drive engine is mounted on the frame, and a mixing barrel is secured to the frame, wherein the improvement comprises:

a rear set of wheels secured to the proximal ends of the pair of handles by frame elements;

a mounting element secured to said frame for supporting said drive engine;

a drive mechanism including a chain and a sprocket operably linked to said drive engine, said first wheel being linked by a drive chain to said drive engine by a toothed wheel mounted on said first wheel, a centrifugal clutch coupled to said drive engine and said sprocket, said first wheel having an internal brake drum and internal brake shoes; said internal brake drum and internal brake shoes being linked to a brake cable having a cam for tension reduction;

a throttle mechanism being operably engaged to said centrifugal clutch and to said drive engine; and a mixing barrel secured to said frame.

8. The mixing apparatus of claim 7, wherein said drive engine is a gasoline powered engine.

9. The mixing apparatus of claim 7, wherein said internal brake drum of said first wheel is operably linked to a brake lever mounted on one of said pair of handles by said brake cable.

10. The mixing apparatus of claim 7, further including a pair of metal skids secured to said frame.

11. The mixing apparatus of claim 7, wherein said rear set of wheels are detachably mounted to said frame.

12. The mixing apparatus of claim 7, wherein said mixing barrel is composed of a metal.

* * * * *